US009964281B2

(12) United States Patent
Windom et al.

(10) Patent No.: US 9,964,281 B2
(45) Date of Patent: May 8, 2018

(54) DUAL FOCUS FLASHLIGHT

(71) Applicant: Coast Cutlery Co., Portland, OR (US)

(72) Inventors: Gregory David Windom, Portland, OR (US); Kam Fu Choo, Vancouver, WA (US); Hai Rong Shi, Yangjiang (CN); Chao Jun Ding, Yangjiang (CN); Shao Jian Feng, Yangiang (CN); Kin Pak Leung, Kowloon (HK)

(73) Assignee: Coast Cutlery Co., Portland, OR (US)

( * ) Notice: Subject to any disclaimer, the term of this patent is extended or adjusted under 35 U.S.C. 154(b) by 273 days.

(21) Appl. No.: 14/685,303

(22) Filed: Apr. 13, 2015

(65) Prior Publication Data

US 2016/0033107 A1 Feb. 4, 2016

Related U.S. Application Data

(60) Provisional application No. 62/032,470, filed on Aug. 1, 2014.

(51) Int. Cl.

| | |
|---|---|
| ***F21L 13/00*** | (2006.01) |
| ***F21V 5/00*** | (2018.01) |
| ***F21L 4/02*** | (2006.01) |
| *F21V 23/04* | (2006.01) |
| *F21Y 115/10* | (2016.01) |
| *F21Y 113/13* | (2016.01) |

(52) U.S. Cl.

CPC ..... *F21V 5/006* (2013.01); *F21L 4/027* (2013.01); *F21V 23/0414* (2013.01); *F21Y 2113/13* (2016.08); *F21Y 2115/10* (2016.08)

(58) Field of Classification Search

CPC ..... F21V 5/006; F21V 23/0414; F21L 4/027
USPC ..... 362/184, 208
See application file for complete search history.

(56) References Cited

U.S. PATENT DOCUMENTS

| | | | |
|---|---|---|---|
| 2,726,321 | A | 12/1955 | Riotto |
| 3,517,185 | A | 6/1970 | Moore |
| 3,622,778 | A | 11/1971 | Cibie et al. |
| 4,803,605 | A | 2/1989 | Schaller et al. |
| 5,077,644 | A | 12/1991 | Schaller et al. |
| 5,876,110 | A | 3/1999 | Uke |
| 6,158,874 | A | 12/2000 | Brustein et al. |

(Continued)

FOREIGN PATENT DOCUMENTS

| | | | |
|---|---|---|---|
| JP | 2003-263907 | A | 9/2003 |
| KR | 10-2005-0056687 | A | 6/2006 |

OTHER PUBLICATIONS

PCT/US15/42946 International Search Report and Written Opinion dated Nov. 11, 2015.

*Primary Examiner* — Elmito Breval
*Assistant Examiner* — Meghan Ulanday
(74) *Attorney, Agent, or Firm* — Schwabe Williamson & Wyatt, P.C.

(57) ABSTRACT

Disclosed are flashlights that optimize the light output and beam focus of both a flood beam and a spot beam. The disclosed flashlights include a housing member and a lens including a first focusing element adapted to shape a light beam into a spot beam and a second focusing element adapted to shape a light beam into a flood beam. A first LED is positioned to direct light through the first focusing element, and a second LED positioned to direct light through the second focusing element. The first LED has a smaller die than the second LED, and the distance between the first LED and the first focusing element is greater than the distance between the second LED and the second focusing element.

23 Claims, 8 Drawing Sheets

(56) References Cited

U.S. PATENT DOCUMENTS

| | | | |
|---|---|---|---|
| 6,800,950 | B2 | 10/2004 | Teshima et al. |
| 7,699,491 | B2 | 4/2010 | Sharrah et al. |
| 8,783,908 | B2 | 7/2014 | Gross et al. |
| 2006/0158895 | A1 | 7/2006 | Brands |
| 2007/0268150 | A1 | 11/2007 | Fraser |
| 2008/0074869 | A1 | 3/2008 | Okishima |
| 2010/0073783 | A1 | 3/2010 | Sun |
| 2011/0063856 | A1 | 3/2011 | Mintz |
| 2012/0176780 | A1 | 7/2012 | Gross |
| 2012/0220256 | A1 | 8/2012 | Tsuge |
| 2013/0301242 | A1 | 11/2013 | Sharrah |
| 2013/0329411 | A1 | 12/2013 | Windom |

DUAL FOCUS FLASHLIGHT

CROSS-REFERENCE TO RELATED APPLICATION

The present application claims priority to U.S. Provisional Patent Application No. 62/032,470, filed Aug. 1, 2014, entitled "FLOOD/SPOT FLASHLIGHT," the disclosure of which is hereby incorporated by reference in its entirety.

TECHNICAL FIELD

The present disclosure relates to dual-focus portable lighting devices, such a flashlights that emit beams having different focal distances and/or beam widths.

BACKGROUND

Flashlights have been produced that allow adjustment of the light beam in a continuous range of beam widths and/or focal distances ranging from a flood beam to a narrow beam, and vice versa. However, such systems typically compromise either the light output of the flood beam or the narrow focus (e.g., beam distance) of the spot beam. For instance, the brightness of the flood light may be compromised in order to achieve a long beam distance with the spot beam, or the beam distance of the spot beam may be compromised in order to achieve more light output in the flood mode, or both.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
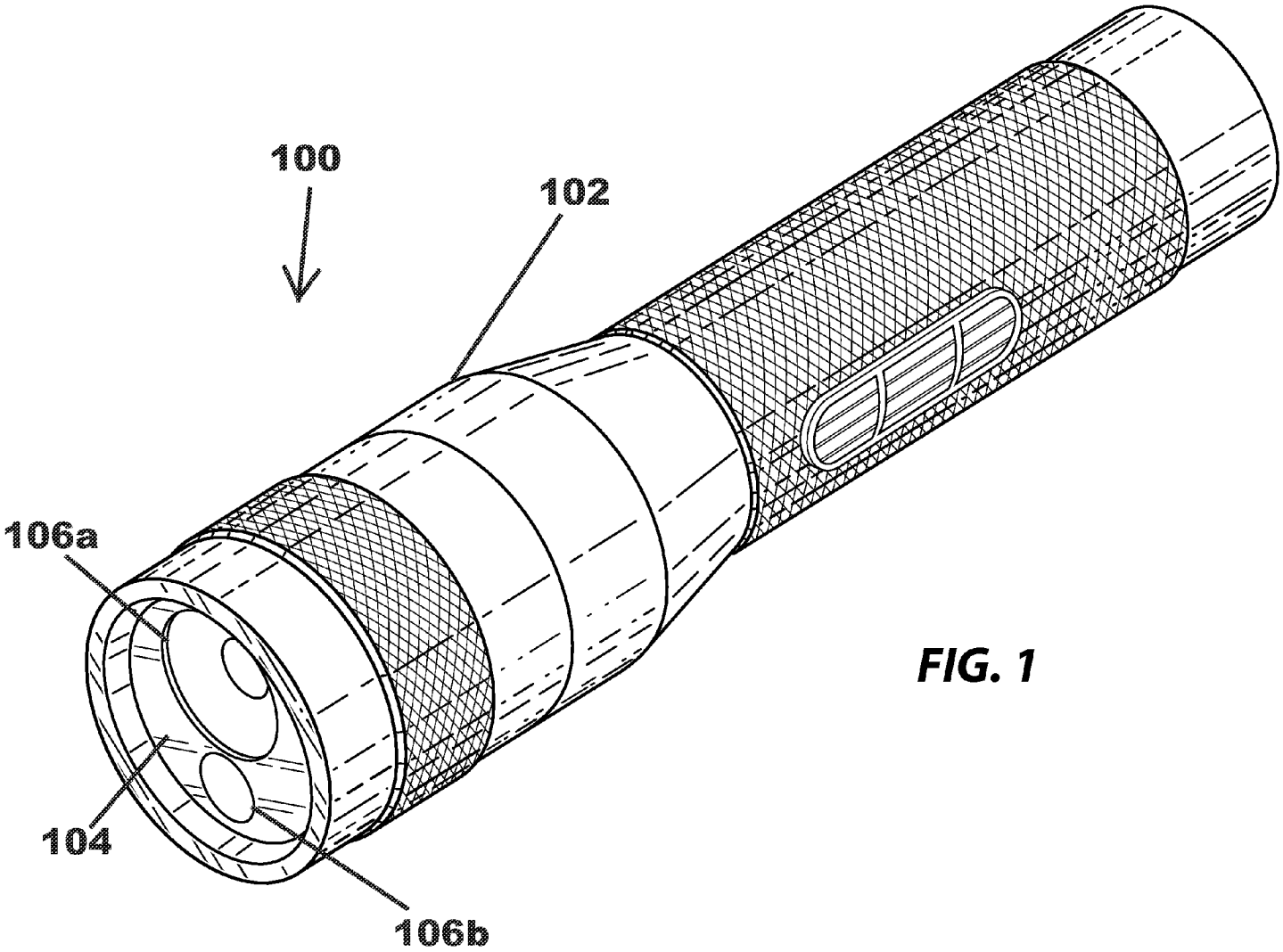
FIG. 1 illustrates a front perspective view of a dual-focus flashlight, wherein the flashlight has a single lens having two separate focusing elements disposed therein, each focusing element offset a short distance from the center of the lens.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

Embodiments herein provide an optical system that allows for a portable lighting device, such as a flashlight, that optimizes the light output and beam focus of both a flood beam and a spot beam. Numerous flashlights exist on the market that allow the distance between the optic and the light source to be adjusted in order to change the focus of the beam from a flood beam into a spot beam, and vice versa. However, these lighting systems have various limitations. Some flashlights seek to optimize light output (e.g., lumens) of the flood beam at the expense of beam distance in the spot beam configuration. Other flashlights seek to optimize beam distance in the spot position, but sacrifice light output in the flood position. Still others compromise both beam distance and light output in an effort to split the difference between producing an optimal flood light and an optimal spot light.

By contrast, various embodiments of the lighting systems disclosed herein include a single lens having two separate focusing elements disposed therein, one for a flood beam and one for a spot beam. In various embodiments, each of the two focusing elements is spaced a small distance from the center of the lens, and each is positioned in front of one of two light sources, such as LEDs. In various embodiments, the flood beam focusing element and the spot beam focusing element are each designed to perform a single function (e.g., either spot or flood beam focusing). For instance, in various embodiments, the flood beam focusing element may be optimized to shape the light beam into a wide, consistent flood beam, which, in various embodiments, may provide bright illumination over a wide area. In various embodiments, the spot beam focusing element may be optimized to focus the light beam into a narrow, bright beam, which, in various embodiments, may travel a great distance.

In various embodiments, the size of each light source also may be optimized to perform optimally under the selected condition (e.g., flood beam or spot beam). In various embodiments, the LED that pairs with the flood beam focusing element (e.g., the flood beam LED) may have a larger size "die" or light-emitting surface compared to the spot beam LED, and in some embodiments it may have a wider viewing angle of light output and/or may emit more lumens than the spot beam LED. In various embodiments, using an LED with a larger die helps produce a wider, brighter light that is more easily dispersed into a wide, bright beam.

Conversely, in various embodiments, the LED that pairs with the spot beam focusing element (e.g., the spot beam LED) may have a smaller size "die" or light-emitting surface (compared to the flood beam LED), and it may have a narrower viewing angle of light output and/or may emit fewer lumens than the flood beam LED. In various embodiments, using an LED with a smaller viewing angle for the spot beam may be helpful because the light leaves the LED in a tighter beam, thereby making it easier to shape into an even tighter beam as it passes through the focusing element. In various embodiments, a smaller "spot beam" LED may emit less light than a larger "flood beam" LED, but the tighter viewing angle means the light will be more intense and "packed" into a smaller beam. In various embodiments, even using a smaller LED, a "tight" spot beam may travel further than a large, spread-out flood beam from the brighter and larger "flood beam" LED.

Additionally, in various embodiments, the distance between each LED and its respective focusing element within the larger lens may be fixed and optimized to produce an optimal flood beam or an optimal spot beam. For instance, each LED may be disposed on a base member that, when installed in the flashlight, positions the larger "flood beam" LED a short distance from the "flood beam" focusing element, and the smaller "spot beam" LED a greater distance from the "spot beam" focusing element. In various embodiments, positioning the "spot beam" LED farther back from the focusing element may allow the "spot beam" focusing element to shape the spot beam into a tight beam. Conversely, positioning the "flood beam" LED a smaller distance from the focusing element may allow the "flood beam" focusing element to disperse the flood beam over a larger area.

Thus, disclosed in various embodiments is a dual-focus flashlight that overcomes the shortcomings of prior art devices. In a conventional single-LED focusing flashlight, one LED must serve as the light source for both the spot beam and the flood beam. In a flashlight having an LED with a small die, a tight viewing angle, and a lower total light output, the resulting spot beam would be bright, tight, and travel a long distance, but the width and total light output of the flood beam would be sacrificed. Conversely, in a flashlight having an LED with a large die, a wide viewing angle, and a high total light output, the flood beam would large and the total lumen rating would be high, but the spot beam would travel a shorter distance, would be wider in size, and would not be as suitable for long distance use. The dual-focus flashlights disclosed herein overcome these issues, and may produce both an optimal spot beam and an optimal flood beam.

Another advantage of the dual-focus flashlights described herein is that they do not include any focus adjustment mechanisms, as the distance between each light source and its focusing element is fixed. Accordingly, in various embodiments, the disclosed flashlights may have few or no moving parts, and as a result, they may be lighter and/or more durable than existing focusing flashlights. Additionally, in various embodiments, a user may toggle between the flood setting, the spot setting, and/or a dual setting wherein both LEDs are lit with the push of a single button or switch, for instance which may be located in any convenient position on the housing, such as the end or a side of the flashlight. For instance, in some embodiments, a user may turn the flashlight on and cycle between "spot" and "flood" modes (or "spot," "flood," and "dual source" modes) with repeated activations of a single push button. In other embodiments, separate buttons or other control elements may be provided for "power," "spot," "flood," and, optionally, "dual source" (e.g., both spot and flood LEDs powered on simultaneously.)

FIG. 1 illustrates a front perspective view of a dual-focus flashlight, wherein the flashlight has a single lens having two separate focusing elements disposed therein, each focusing element offset a short distance from the center of the lens, in accordance with various embodiments. In the illustrated embodiment, the flashlight 100 may have a traditional or conventional elongated housing 102 with a single lens 104 at one end. In various embodiments, lens 104 may include two separate focusing elements, 106*a*, 106*b*, for shaping a light beam into a spot beam with a spot beam focusing element 106*a*, or for shaping a light beam into a flood beam with a flood beam focusing element 106*b*. Although lens 104 is illustrated as round, one of skill in the art will appreciate that it may take other forms, such as a quadrilateral, oval, or crescent.

In various embodiments, both of the spot focusing element 106*a* and the flood focusing element 106*b* may be spaced slightly away from the center point of lens 104. Although the illustrated embodiment shows the two focusing elements 106*a*, 106*b* as being spaced slightly different distances from the geometric center point of lens 104, in other embodiments they may be spaced approximately the same distance from the geometric center point of lens 104. Additionally, although the two focusing elements 106*a*, 106*b* are illustrated as being different sizes, in other embodiments they may have substantially similar diameters.

Figure 2:
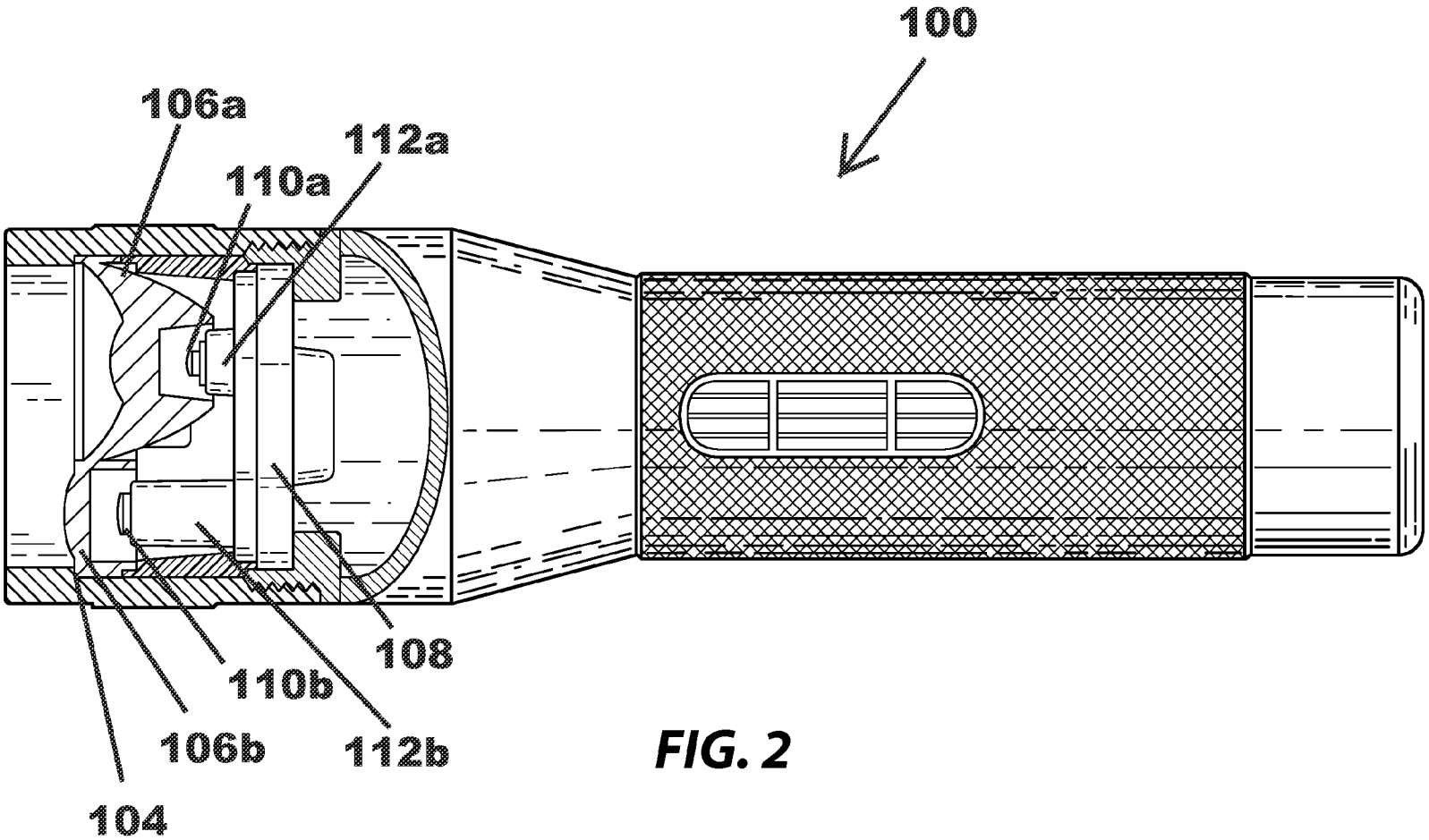
FIG. 2 illustrates a partial cutaway view of the dual-focus flashlight of FIG. 1, showing a partial cross sectional view through each of the two focusing elements, and showing two LED light sources having two different intensities, wherein one of the two LEDs is positioned behind each focusing element, and wherein each LED is mounted a different distance from its respective focusing element.

FIG. 2 illustrates a partial cutaway view of the dual-focus flashlight of FIG. 1, in accordance with various embodiments. In the illustrated embodiment, a partial cross sectional view can be seen through each of the two focusing elements 106*a*, 106*b*, and two LED light sources 110*a*, 110*b* each having a different intensity, are positioned directly behind the lens 104. In various embodiments, the spot beam LED 110*a* may be centered behind the spot beam focusing element 106*a*, and the flood beam LED 110*b* may be centered behind the flood beam focusing element 106*b*. In various embodiments, the spot beam LED 110*a* may have a smaller die and a narrower viewing angle compared to the flood beam LED 110*b*, which may have a correspondingly larger die and a wider viewing angle. In various embodiments, these differences in size, viewing angle, and brightness (e.g., lumens) may work in concert with the different focusing elements 106*a*, 106*b* to produce a tight spot beam with a long beam distance and a bright and wide flood beam.

In various embodiments, the two LEDs 110*a*, 110*b* may be mounted to a base member 108, which may include two pedestals 112*a*, 112*b* configured to position each of the two LEDs 110*a*, 110*b* the optimal focusing distance behind each focusing element 106*a*, 106*b* to create an optimal spot beam and an optimal flood beam. In the illustrated embodiment, the distance between the spot beam focusing element 106*a* and the spot beam LED 110*a* is greater than the distance between the flood beam focusing element 106*b* and the flood beam LED 110*b*. In various embodiments, this difference in spacing may be due, at least in part, to the different optics of the spot beam focusing element 106*a* and the flood beam focusing element 106*b*.

Figure 3A:
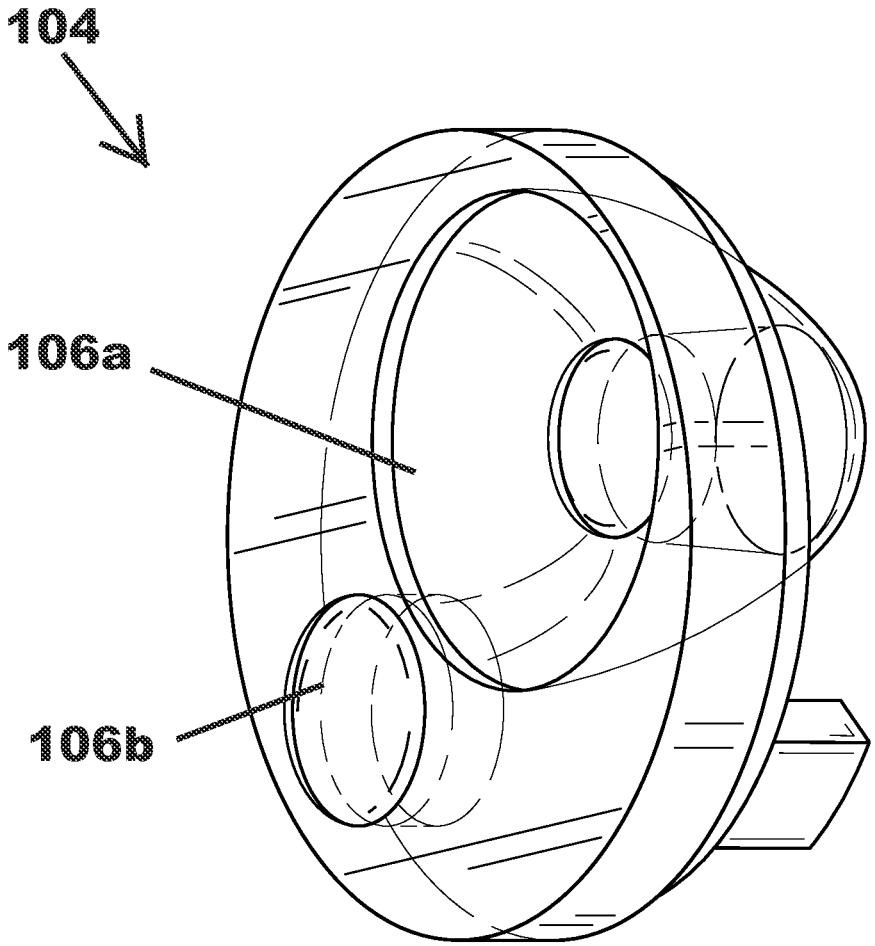
FIGS. 3A and 3B show a perspective view (FIG. 3A) and a cross-sectional view (FIG. 3B) of the lens of the dual-focus flashlight of FIG. 1, illustrating the two focusing elements, each of which is spaced slightly away from the center of the lens.
Figure 3B:
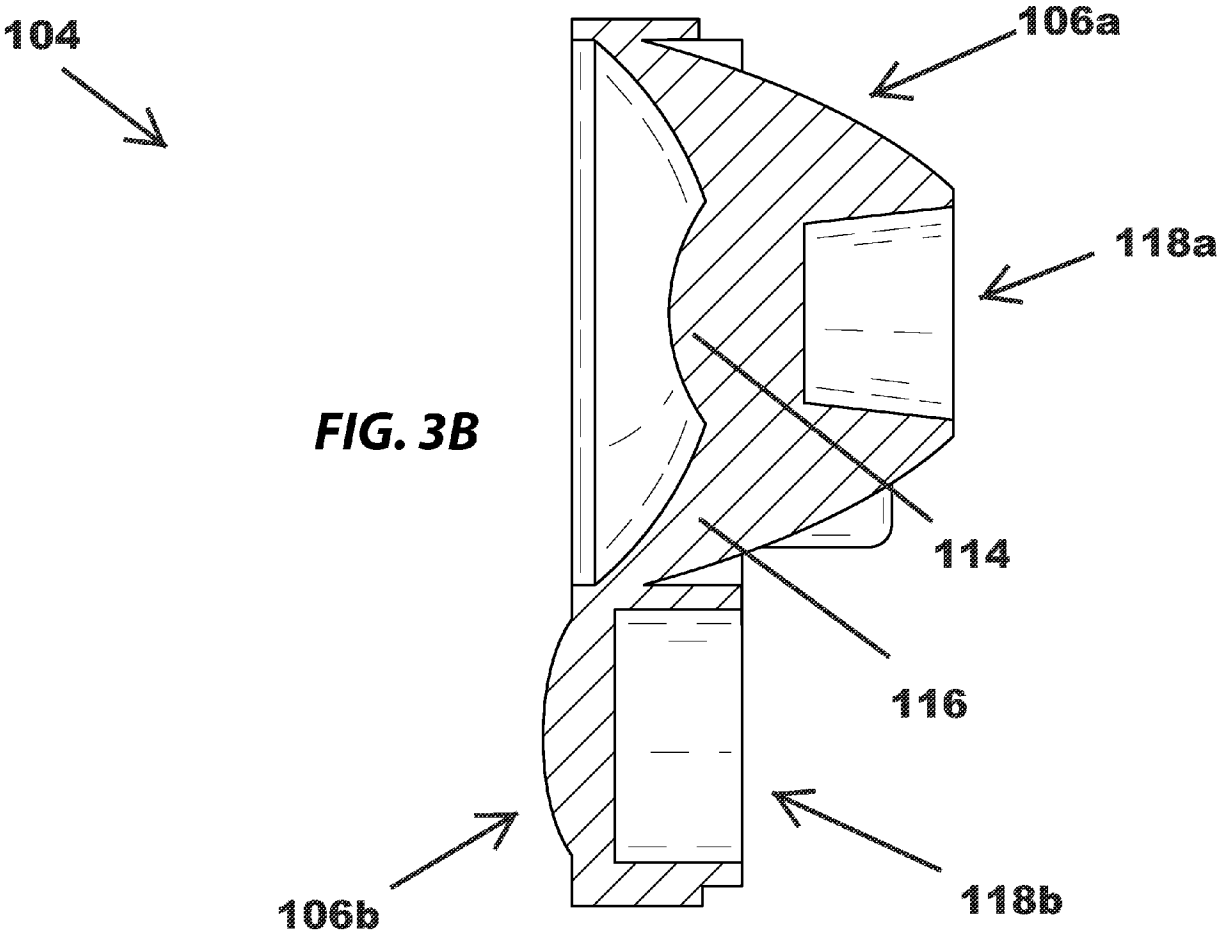

FIGS. 3A and 3B show a perspective view (FIG. 3A) and a cross-sectional view (FIG. 3B) of the lens of the dual-focus flashlight of FIG. 1, illustrating the two focusing elements, each of which is spaced slightly away from the center of the lens, in accordance with various embodiments. In the illustrated embodiment, lens 104 includes two focusing elements 106*a*, 106*b*, and in various embodiments, the flood beam focusing element 106*b* may include a plano-convex, bi-convex, convex-concave, or meniscus lens adapted to disperse the light in a wide beam. Although the flood beam focusing element 106*b* is illustrated as being generally round, in some embodiments, the flood beam focusing element 106*b* may have an oval or elongated shape. For example, in some applications, such as automobile, motorcycle, or bicycle headlights, it may be advantageous to shape the light beam to extend out to the sides of a user's peripheral vision, rather than waste light by sending it upwards, where illumination is not needed. In some applications, an oval beam may be closer in shape to a human being's natural field of vision than a conventional round beam.

As best seen in FIG. 3B, in various embodiments, the spot beam focusing element 106*a* may be a more complex lens having a central focusing element 114 and an annular ring portion 116 that work in concert to focus the light into a narrow, tight beam. In various embodiments, the central focusing element 114 may be a plano-convex, bi-convex, convex-concave, or meniscus lens.

In some embodiments, either or both of the spot beam focusing element 106*a* and the flood beam focusing element 106*b* may include a rear void 118*a*, 118*b*, which may be adapted for receiving at least a portion of the LED and/or pedestal. In various embodiments, the spot beam may use internal reflection to "collect" light and reflect it forward. For example, light rays may pass through the central focusing element, and then may be reflected forward in a narrow, focused beam by the internal or external sidewalls of the annular portion of the lens. This feature is best illustrated in FIG. 5B, which is discussed in greater detail below.

Figure 4A:
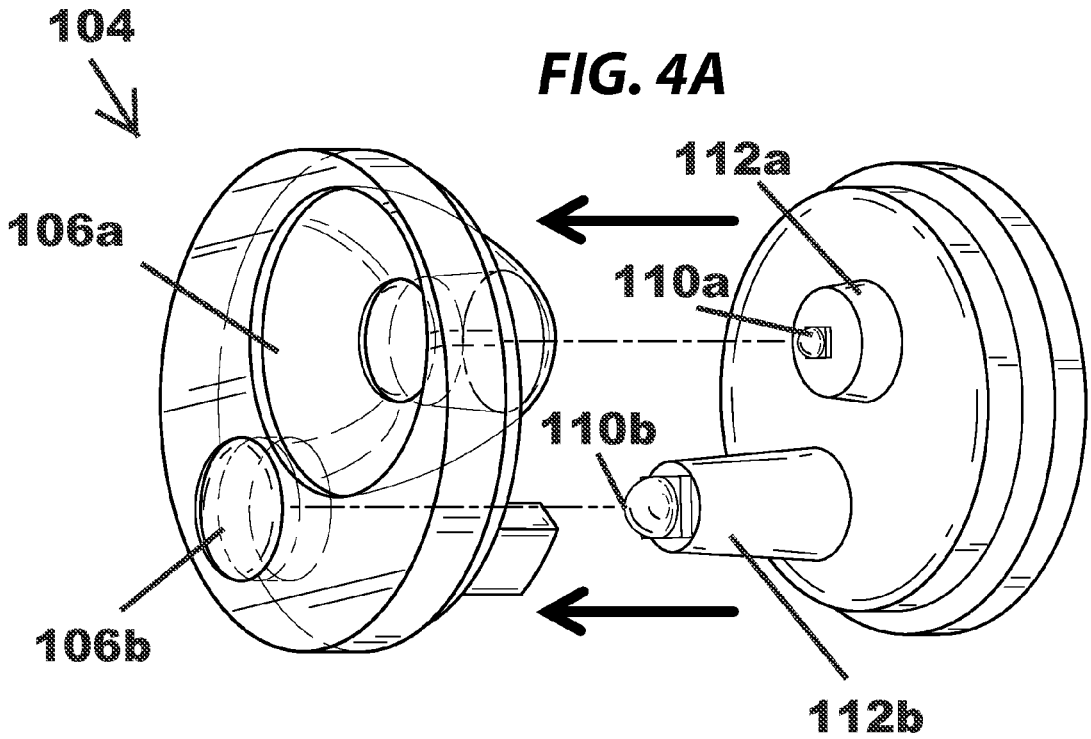
FIGS. 4A and 4B an exploded view (FIG. 4A) and a perspective view (FIG. 4B) of the lens and base member of the dual-focus flashlight of FIG. 1, illustrating the two focusing elements and a base member with two LED light sources mounted thereto.
Figure 4B:
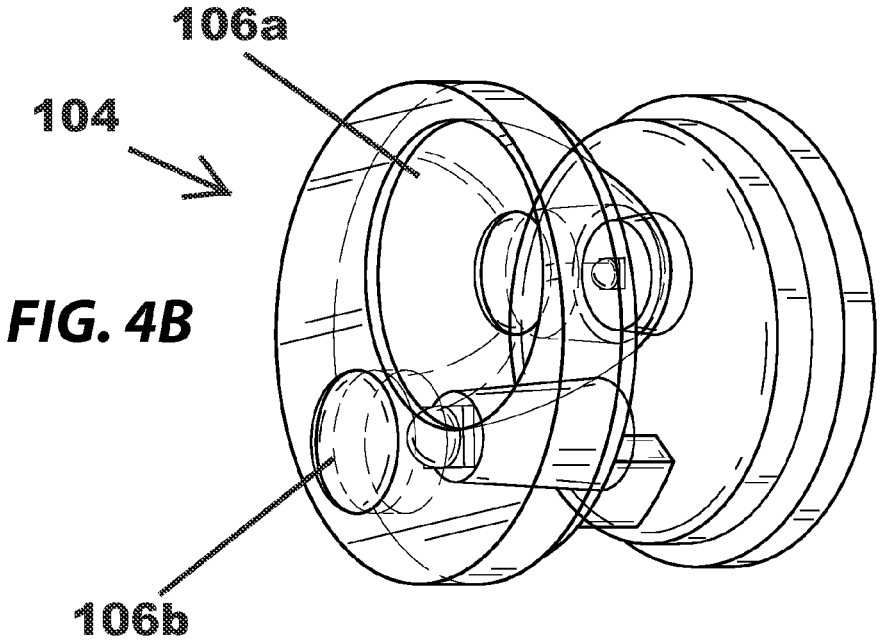

FIGS. 4A and 4B show an exploded view (FIG. 4A) and a perspective view (FIG. 4B) of the lens of the dual-focus flashlight of FIG. 1, illustrating the two focusing elements, and a base member with two LED light sources mounted thereto, in accordance with various embodiments. In some embodiments, the lens 104 may include rear voids 118*a*, 118*b*, which may be adapted for receiving at least a portion of the LEDs 110*a*, 110*b* and/or pedestals 112*a*, 112*b*.

Figure 5A:
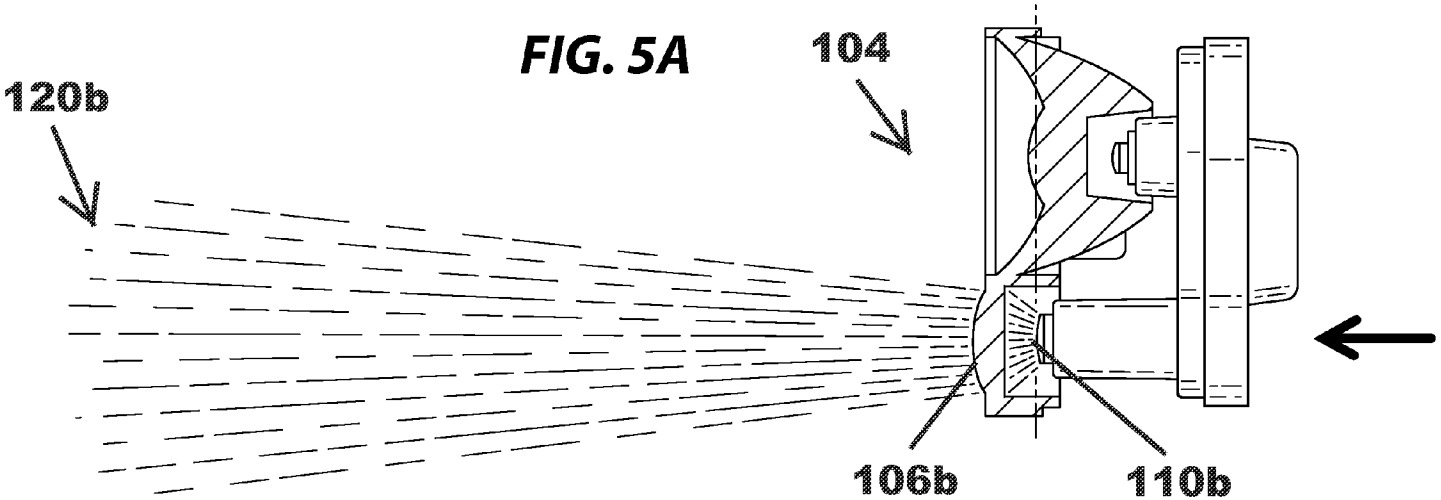
FIG. 5A and 5B are two cross sectional views of the lens, base member, and LEDs of FIG. 4, showing the light distribution from the flood focusing element/LED (FIG. 5A) and the spot focusing element/LED (FIG. 5B)
Figure 5B:
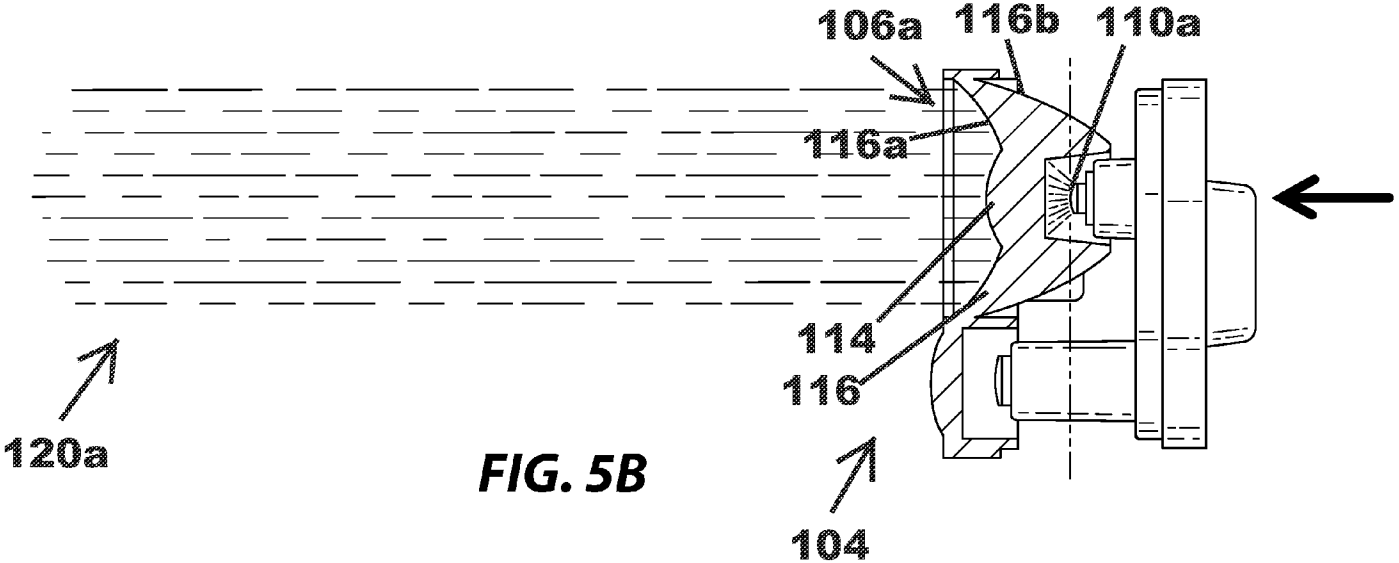

FIG. 5A and 5B are two cross sectional views of the lens, base member, and LEDs of FIG. 4, showing the light distribution from the flood focusing element/LED (FIG. 5A) and the spot focusing element/LED (FIG. 5B), in accordance with various embodiments. As shown in FIG. 5A, as light passes from the flood beam LED 110*b* through the flood beam focusing element 106*b* of lens 104, the flood beam focusing element 106*b* directs the light into a wide, bright flood beam 120*b*. As shown in FIG. 5B, as light passes from the spot beam LED 110*a* through the spot beam focusing element 106*a* of lens 104, the central focusing element 114 and the annular ring portion 116 of the spot beam focusing element 106*a* work in concert to direct the light into a tight, narrow spot beam 120*a*. In some embodiments, the annular ring portion may reflect light in a forward direction from the inner side wall 116*a* of the annular ring portion 116, whereas in other embodiments, the annular ring portion may reflect light in a forward direction from the outer side wall 116*b*, or both.

Figure 6A:
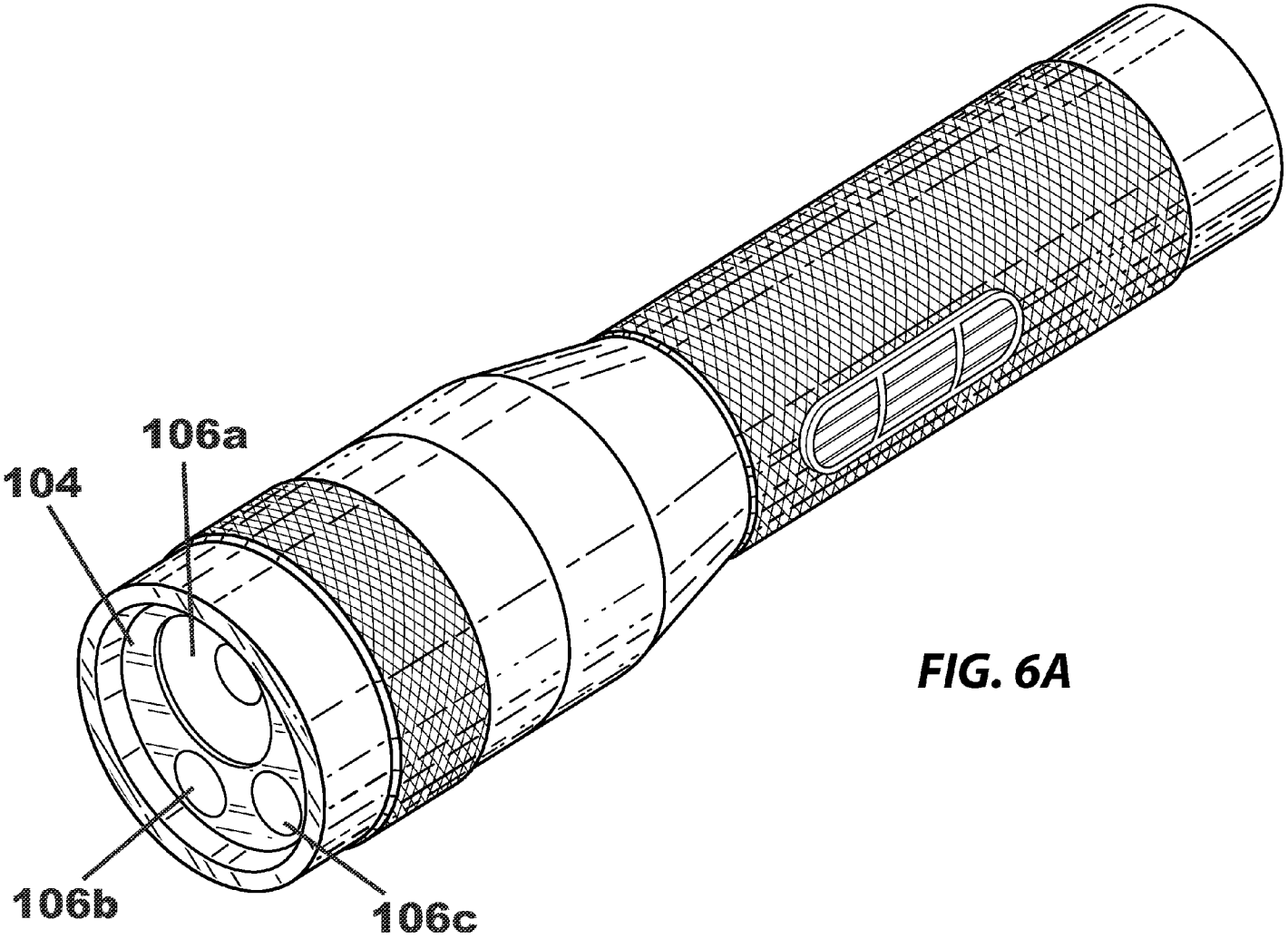
FIGS. 6A and 6B are perspective views of a flashlight having a lens with three focusing elements, and a lens with four focusing elements, all in accordance with various embodiments.
Figure 6B:
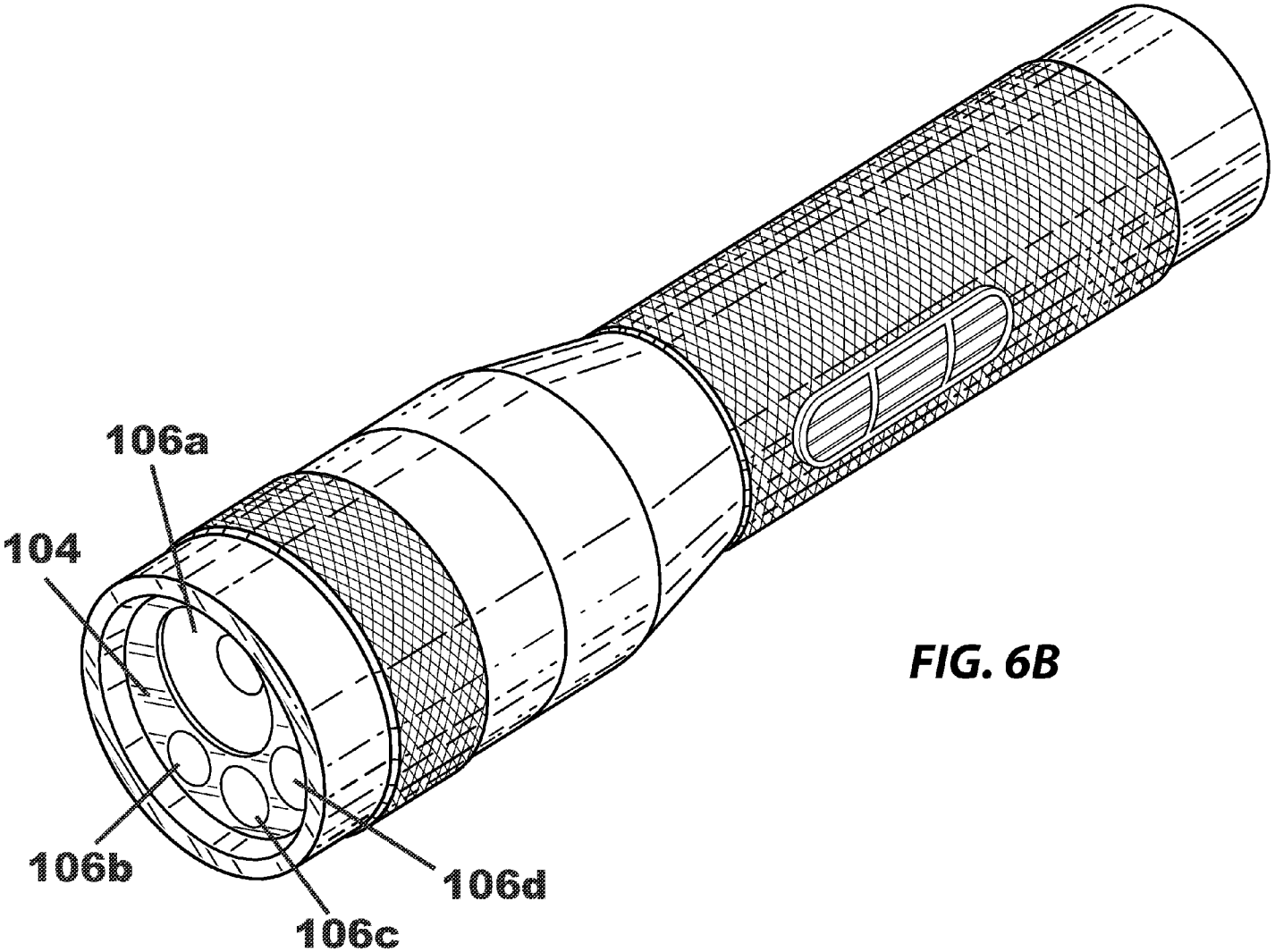

One of skill in the art will appreciate that in some situations, it may be desirable to illuminate both the spot beam LED and the flood beam LED simultaneously, for instance when a long distance beam is needed, but general illumination of the near field is also desired. In these instances, both the spot beam LED and the flood beam LED may be illuminated simultaneously. Additionally, as shown in FIGS. 6A and 6B, in various embodiments, the lens 104 may include three (FIG. 6A) or four (FIG. 6B) separate focusing elements, 106*a*, 106*b*, 106*c*, and 106*d*, for shaping a light beam into a spot beam with a spot beam focusing element 106*a*, for shaping a light beam into a flood beam with a flood beam focusing element 106*b*, and additional focusing elements for shaping a light beam from third (and optionally fourth or more) light sources. Although focusing elements 106*c* and 106*d* are illustrated as flood beam focusing elements, one of skill in the art will appreciate that additional spot beam focusing elements, or even simple reflectors, may be substituted. In various embodiments, the additional light sources may be colored LEDS, such as red, blue, green, or UV LEDs, or they may be infrared LEDs. For instance, in various embodiments, an infrared LED may be used in conjunction with night vision goggles.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A dual-focus flashlight comprising:

a housing member;

a lens having a geometric center point, wherein the lens comprises:

a first focusing element, wherein the first focusing element is adapted to shape a light beam into a spot beam, and wherein the first focusing element is spaced a first distance from the geometric center point of the lens; and a second focusing element, wherein the second focusing element is adapted to shape a light beam into a flood beam, and wherein the second focusing element is spaced a second distance from the geometric center point of the lens;

a first LED positioned to direct light through the first focusing element;

a second LED positioned to direct light through the second focusing element;

a power source disposed within the housing member and adapted to provide power to the first and second LEDs; and a control element configured to selectively provide power to the first LED, the second LED, or both the first and second LEDs, wherein the first LED has a smaller die than the second LED, and wherein the distance between the first LED and the first focusing element is greater than the distance between the second LED and the second focusing element.

2. The flashlight of claim 1, wherein the first focusing element comprises a central focusing element and an annular ring portion extending from and surrounding the central focusing element.

3. The flashlight of claim 2, wherein the central focusing element comprises a plano-convex, convex-concave, or meniscus lens.

4. The flashlight of claim 1, wherein the second focusing element comprises a plano-convex, convex-concave, or meniscus lens.

5. The flashlight of claim 3, wherein the second focusing element consists essentially of a plano-convex, convex-concave, or meniscus lens.

6. The flashlight of claim 2, wherein the first focusing element further comprises a side wall extending from the central focusing element and configured to form a rear void for receiving at least a portion of the first LED.

7. The flashlight of claim 2, wherein the second focusing element further comprises a side wall extending therefrom and configured to form a rear void for receiving at least a portion of the second LED.

8. The flashlight of claim 6, wherein the second focusing element further comprises a side wall extending therefrom and configured to form a rear void for receiving at least a portion of the second LED.

9. The flashlight of claim 1, wherein the flashlight further comprises a base member to which the first and second LEDs are mounted.

10. The flashlight of claim 9, wherein the base member comprises a first pedestal configured to position the first LED in a position relative to the first focusing member, and wherein the position of the first LED is selected to generate an optimal spot beam.

11. The flashlight of claim 9, wherein the base member comprises a second pedestal configured to position the second LED in a position relative to the second focusing member, and wherein the position of the second LED is selected to generate an optimal flood beam.

12. The flashlight of claim 10, wherein the base member comprises a second pedestal configured to position the second LED in a position relative to the second focusing member, and wherein the position of the second LED is selected to generate an optimal flood beam.

13. The flashlight of claim 1, wherein the first and second distances from the geometric center point of the lens are substantially the same.

14. The flashlight of claim 1, wherein the first and second distances from the geometric center point of the lens are different.

15. The flashlight of claim 1, wherein the control element is a switch.

16. The flashlight of claim 15, wherein repeated activation of the switch causes the flashlight to change modes, and wherein a first mode causes only the first LED to be activated and a second mode causes only the second LED to be activated.

17. The flashlight of claim 16, wherein a third mode causes both the first and second LEDs to be activated.

18. The flashlight of claim 17, wherein a fourth mode causes the flashlight to power off.

19. A dual-focus lens for a flashlight comprising:

a geometric center point;

a first focusing element, wherein the first focusing element is adapted to shape a light beam into a spot beam, and wherein the first focusing element is spaced a first distance from the geometric center point of the lens; and a second focusing element, wherein the second focusing element is adapted to shape a light beam into a flood beam, and wherein the second focusing element is spaced a second distance from the geometric center point of the lens.

20. The flashlight of claim 19, wherein the first focusing element comprises a central focusing element and an annular ring portion extending from and surrounding the central focusing element.

21. The flashlight of claim 20, wherein the second focusing element comprises a plano-convex, convex-concave, or meniscus lens.

22. The flashlight of claim 20, wherein the first focusing element further comprises a side wall extending from the central focusing element and configured to form a rear void for receiving at least a portion of a first LED.

23. The flashlight of claim 22, wherein the second focusing element further comprises a side wall extending therefrom and configured to form a rear void for receiving at least a portion of a second LED.

* * * * *